United States Patent [19]

Latimer

[11] 4,408,404

[45] Oct. 11, 1983

[54] PIVOTABLE ARTICULATED SUPPORT SHOE FOR HYDRAULIC NOZZLE

[75] Inventor: John P. Latimer, Newport News, Va.

[73] Assignee: Deepsea Ventures, Inc., Gloucester Point, Va.

[21] Appl. No.: 185,309

[22] Filed: Sep. 8, 1980

[51] Int. Cl.[3] ..... E02F 3/92

[52] U.S. Cl. ..... 37/58; 37/DIG. 8

[58] Field of Search ..... 37/58, 65, 67, 72, DIG. 8; 299/8; 172/307, 417, 484, 665, 738

[56] References Cited

U.S. PATENT DOCUMENTS

| | | | |
|---|---|---|---|
| 407,044 | 7/1889 | Von Schmidt | 37/65 |
| 3,171,219 | 3/1965 | Kaufmann et al. | 37/67 X |
| 3,579,872 | 5/1971 | Jantzen | 37/72 X |
| 3,988,843 | 11/1976 | Brockett | 37/DIG. 8 |
| 4,319,414 | 3/1982 | Latimer et al. | 37/58 |

FOREIGN PATENT DOCUMENTS

| | | | |
|---|---|---|---|
| 2137218 | 1/1972 | Fed. Rep. of Germany | 37/58 |
| 2439485 | 2/1976 | Fed. Rep. of Germany | 299/8 |
| 608936 | 5/1978 | U.S.S.R. | 299/8 |

*Primary Examiner*—Edgar S. Burr
*Assistant Examiner*—Moshe I. Cohen
*Attorney, Agent, or Firm*—Barry G. Magidoff

[57] ABSTRACT

This invention provides means for supporting a hydraulic nozzle (of the type utilized, for example, to obtain valuable mineral ores from ocean depths) with a support surface in a manner so that the attitude of the support surface relative to the ocean floor remains constant. The means includes a system of pivotable, parallel levers or supports which interact during pivoting of the support surface to maintain the support surface in the same attitude.

16 Claims, 3 Drawing Figures

PIVOTABLE ARTICULATED SUPPORT SHOE FOR HYDRAULIC NOZZLE

This invention relates to means for raising and lowering a support surface for an hydraulic nozzle of a dredge device in a manner so that the angle between the support surface and the ocean floor is kept constant.

With the recognition of the limited supplies of raw materials, and especially metals, from previously available terrestrial mine sites, a great deal of effort has been put into the development of means to mine valuable metal ores from the abyssal depths of the oceans. Such means have generally centered about the utilization of extremely deep water dredging means, especially at depths of between 10,000 and 18,000 feet, to bring up what is known as ocean floor nodule ore, or manganese nodules.

The extreme conditions met at such great ocean depths, particularly in the way of pressures, have necessitated the development of a new generation of dredging equipment. Generally, a dredging means is connected to a surface vessel by way of a device for bringing the ore from the ocean floor to the surface. The dredging head can be, for example, of the suction nozzle variety, wherein the ore is literally sucked into a nozzle, much in the way of a vacuum cleaner, and then transferred to the vertical means rising to the surface. Such vertical means, generally utilized in combination with a suction head nozzle, include hydraulic means for lifting the ore suspended in, generally, water. Mechanical means for the removal of such ocean floor ores have also been utilized, including, for example, continuous bucket chains or digging scoops.

Deposits of valuable metal ores are found lying on the surface of the soft sea floor as nodules, or as generally fist-sized "rocks" which are only partially immersed within the sediment on the ocean floor. The nodule materials, of course, vary greatly in size, from what can be considered relatively small pebbles or even grains, up to relatively large rocks, or even boulders. Granite and other stone boulders are of course also often encountered when passing along the deep ocean floor.

The ocean floor where such nodules are located has been found to be covered with a sediment similar to mud, of varying consistency. The supporting dredge vehicle may sink runners into the sediment. Where the sea floor is relatively firm, the runners will ride entirely above the surface, but where the sediment is deep and/or soft, the runners can sink below the sediment surface, causing the nozzle inlet to be submerged in the sediment. There are also variations in microtopography along the ocean floor which the dredge vehicle will encounter during operation.

It has now been found that in order to maximize the recovery of ore nodules and minimize the amount of fine sediment taken into the suction nozzle, it is necessary to maintain an optimum relationship between the nozzle inlet and the surface of the sediment by means of a support surface directly connected to the nozzle. It has also now been found that it is desirable that the support surface be maintained at a constant attitude relative to the ocean floor. It is accordingly an object of the present invention to improve the effectiveness of such a support surface.

In accordance with the present invention, there is provided a dredging vehicle adapted to be moved in a forward direction through a body of water, dredging means supported by the vehicle, preferably of the suction type, and having a dredge nozzle inlet adjacent the bottom of the vehicle, and facing in at least a partially forwardly direction, and nozzle support means comprising a pivotably connected support surface designed to be raised and lowered relative to the nozzle opening while maintaining a constant attitude relative to the ocean floor.

In a preferred embodiment, the dredging means comprises a suction nozzle having a nozzle inlet located adjacent the bottom of the nozzle, the rearward portion of the nozzle inlet being adjacent the support surface. The nozzle inlet is further preferably facing in a generally forwardly, and partially obliquely downwardly, direction.

Preferably, there is also provided means for remotely vertically adjusting the support surface in relation to the nozzle inlet. The articulation of the support surface is by way of a system of pairs of parallel levers, which pivotally interact as the nozzle pivots during operation so as to maintain the support surface at the same angle relative to the ocean floor.

In a preferred embodiment of this invention, the dredging means, specifically the suction type nozzle means, is pivotally supported from above by the dredge vehicle chassis. In order to maintain the support surface at an optimum angle relative to the ocean floor, in the preferred embodiment, two parallelograms are defined by the various pivot points, each parallelogram having a pair of sides with fixed attitudes in relation to the ocean floor and in relation to the other parallelogram.

A further understanding of the present invention can be obtained by reference to the preferred embodiment set forth in the illustrations of the accompanying drawings. The illustrated embodiment, however, is merely exemplary of certain presently known preferred means for carrying out the present invention. The drawings are not intended to limit the scope of this invention, but merely to clarify and exemplify, without being exclusive thereof.

Referring to the drawings.

Figure 1:
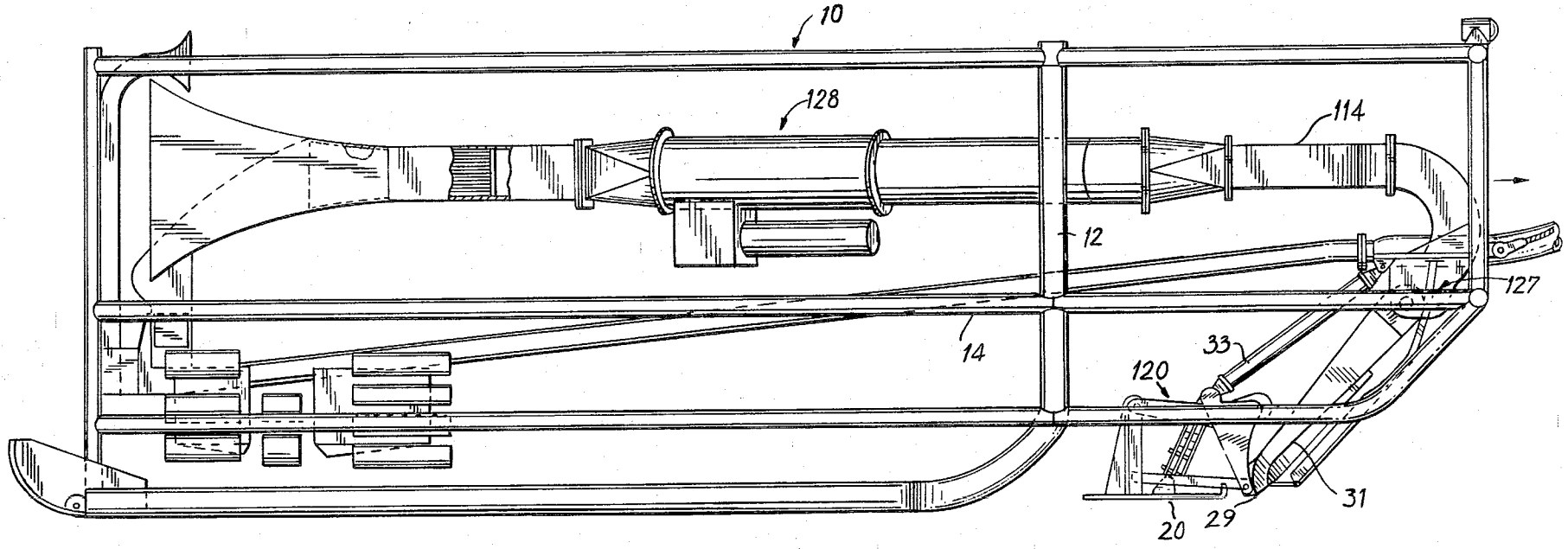
FIG. 1 is a side elevation view of a dredge vehicle including the present invention.
Figure 2:
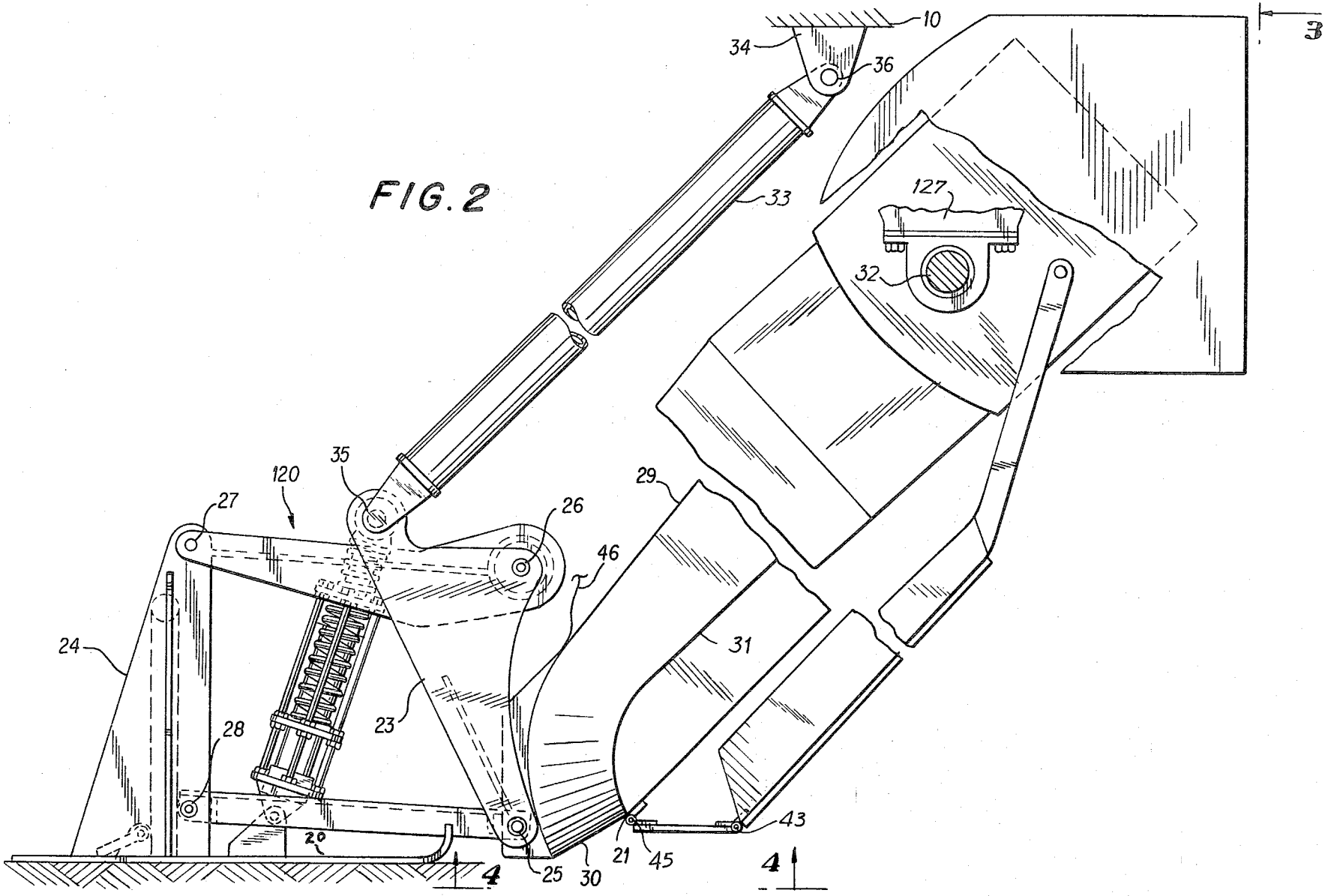
FIG. 2 is a magnified side view showing the portion of the vehicle comprising the present invention.
Figure 3:
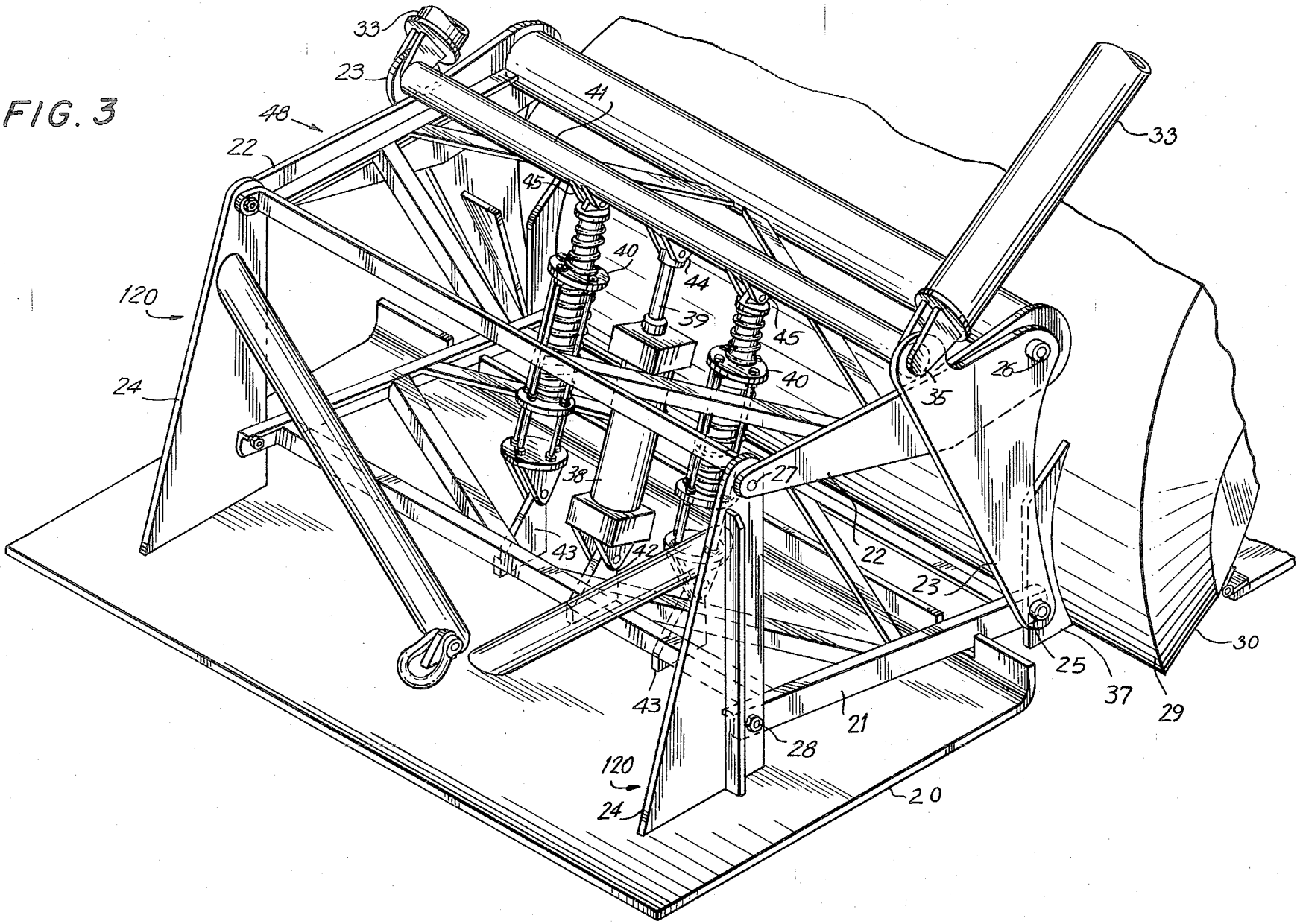
FIG. 3 is a perspective view of the present invention.

A dredge vehicle chassis, generally indicated by the numeral 10 is formed of a plurality of intersecting vertical tubular frame members 12 and horizontal tubular frame members 14. A suction nozzle 29 is pivotably supported from the chassis 10 via a pillow block support 127. The nozzle 29 is in turn flexibly connected to the water conduit 114, by a conventional seal not shown. Alternatively, the nozzle 29 can be pivotably supported directly by the water conduit 114, the seal between the nozzle and the duct being a part of that supporting joint structure. The water conduit 114 is in turn in fluid-flow connection with a suction pump, indicated generally by the numeral 128.

As shown in this embodiment, the nozzle 29 has a generally obliquely elongated forward surface 31 presented to the free-flow stream of water, moving towards the rear of the vehicle chassis 10 when the dredge vehicle is being pulled through the water during the dredging operation.

The support shoe 20 is connected to the nozzle 29 by an articulated adjusting mechanism, generally indicated by the number 120. The support shoe 20 is rigidly connected to two rear lever support brackets 24, which are each pivotally connected to an upper and lower lever, 22 and 21, by pins 27 and 28. The upper and lower levers, 22 and 21, are both pivotally attached to a forward lever plate 23 by pins 26 and 25, respectively. Pin 25 also pivotally joins the lower lever 21 and forward lever plate 23 with the lower rear portion of the nozzle 29 via bracket 37. Unless otherwise stated, all of the pivoting joints described herein pivot about horizontal axes that are mutually parallel and perpendicular to the longitudinal centerline of the dredge vehicle. The locations of this first set of pivot points are such that each set of pins 25, 26, 27 and 28 forms a first parallelogram regardless of the position of the support shoe 20.

The entire support shoe articulated adjusting mechanism 120 is pivotally connected to two support members 33 through a common axis passing through the support connecting rod 41 at the two forward lever plates 23. Pivot points 35, 25, 26 in this embodiment form a triangle. The upper end of each shoe support member 33 is pivotally connected by pin 36 to bracket 34, which is fixedly attached to the chassis frame 10. The nozzle 29 is pivotally supported at its upper end by a pillow block support 127 (rigidly connected to the chassis), to which it is attached by pin 32. The locations of this second set of pivot points are such that a second parallelogram is defined by pins 36, 32, 25 and 35 whereby the opposite sides remain parallel regardless of the angle between the nozzle 29 and the ocean floor.

A hydraulic cylinder 38 and hydraulic piston rod 39 are pivotally connected to brackets 42 and 44, respectively, which are fixedly attached to the support shoe 20 and the center of connecting rod 41, respectively. Two compression spring packs 40 are pivotally connected to brackets 45 and 43, which are also fixedly attached to the support shoe 20 and connecting rod 41, respectively. A flexible support cable 46 is pivotally connected to the lower portion of the rearward surface of the nozzle; the other end of support wire 46 is attached to a remotely controllable winch (not shown) on the chassis frame.

In operation, as the dredge vehicle 10 moves along the ocean floor, the lower surface of the support shoe 20 rides along and is supported by the ocean floor, while supporting the nozzle 29, and especially the nozzle opening 30, above the ocean floor. If the nozzle opening 30 is in too low a position in relation to the ocean floor, and it is desired to raise the nozzle 29, the remotely controllable hydraulic cylinder is activated. The piston rod 39 is pushed outwardly from the hydraulic cylinder 38, pushing the connecting rod 41 upwardly. This, in turn, causes the forward lever plates 23 to pivot upwardly, pulling the nozzle 29 upwardly by the brackets 37. The forward plates 23, pivot about the rear brackets 24, via the levers 21,22, causing the nozzle opening 30 to move upwardly and rearwardly in relation to the support shoe 20 and the ocean floor, and the chassis frame 10. Referring to the second parallelogram 25, 35, 36 and 32, the side 25, 35 moves upwardly and rearwardly. Since the side 32, 36 is at a fixed attitude (or angle), in relation to the chassis frame (and, therefore, generally to the ocean floor), and since second parallelogram side 35, 25 is always parallel to the side 32, 36, and since the angle defined by pins 35, 25, 26 is a constant, and since first parallelogram side 27, 28 is always parallel to side 25, 26, it follows that the support shoe 20 remains at a fixed attitude or angle in relation to the ocean floor during operation.

Conversely, if the nozzle opening 30 is located too high in relation to the support shoe 20, the remotely controllable cylinder is actuated to pull the piston rod 39 into the cylinder 38, pulling the connecting rod 41 downwardly. This reverses the action described above for using the nozzle, and results in the nozzle 29 being pulled downwardly towards the support shoe 20, thus bringing the nozzle opening 30 closer to the ocean floor. The first parallelogram side 25, 26 moves downwardly in relation to the side 25,26, and the second parallelogram side 25, 35 moves downwardly and to the right in relation to the side 32, 36.

The compression springs 40 are designed to return the support shoe 20 to a preselected position (preferably so that the bottom of the support shoe is 4 inches below the lower edge of the nozzle entrance 30) in the event of a failure of the hydraulic cylinder 38 or its control mechanism. The support wire 46 and winch are available in order to hoist the nozzle 29 and the entire support shoe mechanism rearwardly and upwardly away from the ocean floor when necessitated by the presence of a large obstruction or when it is desired that the dredge vehicle not engage in mining.

As a result of this invention, the efficiency of ore nodule intake is increased because the nozzle inlet can be maintained at an optimum position in relation to the ocean floor. The efficiency of a support surface is also increased by maintaining it at a constant angle in relation to the horizontal thereby avoiding undesirable drag.

The dredge vehicle can be any of a variety of devices, including the sled-type vehicle shown in the drawings, a wheeled vehicle, a tracked vehicle, or other means for supporting the dredge head above, or on the surface of the ocean floor. Any type of vehicle now known or developed in the future, including those which are self-propelled and those which are merely towed, can be utilized. Similarly, any materials can be used for construction of the vehicle, the nozzle or the water deflecting shield, including any metal or synthetic polymeric plastic material now known or to be developed.

It is further found to be desirable to include a plurality of dredging means, e.g., nozzles, suspended from a single vehicle. As an example, each nozzle is independently pivotally suspended about an axis parallel to the surface upon which the vehicle rides and perpendicular to the intended direction of movement, so as to permit each such nozzle to ride over an undulating or uneven surface independently. Each pivotable nozzle can, therefore, be pivoted above the surface of the sea bottom independently of the other nozzles, whereby the nozzles can more closely follow a surface which undulates in a direction perpendicular to the direction of movement.

The patentable embodiments of this invention which are claimed are as follows:

1. A dredge vehicle capable of moving along the floor of a body of water, the dredge vehicle comprising:

(a) a chassis;

(b) a nozzle pivotally supported from its top by the chassis;

(c) a support surface adjacent the nozzle bottom;

(d) support surface connecting means for pivotally connecting the support surface to the nozzle, the connecting means comprising four pivotally interconnected rigid connecting members, the pivotal connections of which define a first parallelogram linkage assembly;

(e) a first rigid supporting member pivotally connected at one portion to the chassis and at a second portion to the support surface connecting means;

(f) a second rigid supporting member pivotally connected at one portion to the nozzle and at a second portion to the first supporting member at a second portion thereof, in a manner such that the pivotal connections between the chassis and the nozzle, the nozzle and the second supporting member, the second and first supporting members, and the first supporting member and the chassis, define a second linkage assembly, wherein straight lines connecting the pivotal connections define a parallelogram;

(g) assembly connecting means for maintaining one side of the first parallelogram linkage assembly at a constant angle in relation to one side of the second linkage assembly such that the support surface is maintained at a fixed angle in relation to the horizontal.

2. The dredge vehicle of claim 1 wherein the third connecting member, the assembly connecting means and the second support member form a unitary rigid plate including three pivotal connections which define a triangle.

3. The dredge vehicle of claim 1 wherein the support surface comprises one continuous flat rectangular surface or shoe.

4. The dredge vehicle of claim 1 wherein the nozzle comprises a suction type nozzle.

5. The dredge vehicle of claim 1 comprising two parallel first supporting members and connecting member extending transversely along the width of the nozzle and connected to each of the two first supporting members and two parallel second support members, forming two parallel, in-line second linkage assemblies with the nozzle and chassis.

6. The dredge vehicle of claim 1 or claim 5, wherein all of the pivoting joints rotate about horizontal axes that are mutually parallel, parallel to the support surface, and perpendicular to the longitudinal centerline of the dredge nozzle.

7. The dredge vehicle of claim 1 comprising biasing means connected between the support surface and the first supporting member, so that the nozzle is biasedly supported to a predetermined distance from the support surface.

8. The dredge vehicle of claim 7 wherein the biasing means comprises one or more spring packs.

9. The dredge vehicle of claim 7 wherein the support surface is rigidly connected to one connecting member extending upwardly towards the chassis; and wherein a second transversely extending, connecting member is pivotally connected to the nozzle and to a third connecting member about the same axis.

10. The dredge vehicle of claim 9 comprising two sets of connecting members forming two parallel, in-line first parallelograms linkage assemblies and a connecting rod pivotally attached at each end to one of the first parallelogram linkage assemblies and extending transversely across the width of the support surface.

11. The dredge vehicle of claim 7 comprising in addition means for remotely vertically adjusting the support surface relative to the nozzle opening.

12. The dredge vehicle of claim 11 wherein the means for remotely adjusting the support surface comprises a hydraulic piston and cylinder acting between the support surface and the first supporting member.

13. The dredge vehicle of claim 11 wherein the support surface is located rearwardly of the nozzle.

14. In a dredge vehicle for mining the ocean floor, the vehicle comprising a chassis; a nozzle supported from the chassis, and a support surface for riding on the ocean floor connected to and for supporting the nozzle, the improvement comprising:

four substantially rigid first members, one of such members being rigidly connected to the support surface, the four members being pivotally interconnected at four separate first pivot points, and the four pivot points defining a first parallelogram linkage assembly;

a second linkage assembly comprising four pivotally interconnected substantially rigid, second elements connected at a second four separate pivot points, one of such interconnected second elements including the nozzle, two of the interconnected second elements being pivotally connected to two locations on the chassis, such that the chassis defines one of the second elements, the straight lines connecting the second four pivot points define a second parallelogram;

one of the second elements being rigidly interconnected to one of said rigid first members such that one of the second pivot points is coaxial with one of the first pivot points enabling the support surface to be maintained at a constant relationship with the ocean floor.

15. The vehicle of claim 14 wherein the nozzle is pivotally interconnected to the chassis, so that two of the pivot points for the second linkage assembly are between a member and the chassis.

16. The vehicle of claim 14 wherein a pivot point of the first parallelogram linkage assembly is coincident with a pivot point of the second parallelogram linkage assembly.

* * * * *

UNITED STATES PATENT AND TRADEMARK OFFICE

CERTIFICATE OF CORRECTION

PATENT NO. : 4,408,404

DATED : October 11, 1983

INVENTOR(S) : John P. Latimer

It is certified that error appears in the above-identified patent and that said Letters Patent are hereby corrected as shown below:

Claim 16, column 6, line 51, delete "parallelogram"

Signed and Sealed this

*Thirteenth* Day of *March 1984*

[SEAL]

*Attest:*

GERALD J. MOSSINGHOFF

*Attesting Officer*

*Commissioner of Patents and Trademarks*